United States Patent [19]

Sogell

[11] Patent Number: 4,811,678

[45] Date of Patent: Mar. 14, 1989

[54] SAILBOAT SAIL WITH A FULL-WIDTH, FULL-DEPTH, HORIZONTALLY OUTSTANDING SHIELD LOCATED AT AN INTERMEDIATE LEVEL

[76] Inventor: Hans Sogell, Yxvägen 19, S-181 47 Lidingö, Sweden

[21] Appl. No.: 106,364

[22] Filed: Oct. 9, 1987

[51] Int. Cl.[4] ..... B63H 9/06

[52] U.S. Cl. ..... 114/103; 114/102; 114/391

[58] Field of Search ..... 114/103, 102, 39.1

[56] References Cited

U.S. PATENT DOCUMENTS 4,122,792 10/1978 Rhoades et al. ..... 114/103
4,344,377 8/1982 Gram ..... 114/103

FOREIGN PATENT DOCUMENTS 717715 2/1942 Fed. Rep. of Germany ..... 114/103
2701243 7/1978 Fed. Rep. of Germany ..... 114/103
2552393 3/1985 France ..... 114/103
2119730 11/1983 United Kingdom ..... 114/103

*Primary Examiner*—Sherman D. Basinger
*Assistant Examiner*—Thomas J. Brahan
*Attorney, Agent, or Firm*—Cushman,Darby & Cushman

[57] ABSTRACT

A sail (1) for sailing-boats which is provided with a shielding device (3) arranged substantially horizontally on the sail (1). The shielding device at least partly bridges the concavity formed on the upwind surface of the sail when the wind fills the sail (1). The shielding device preferably includes a cloth (3) sewn along one of its own side edges to the sail along a horizontal line so that, in use, the cloth stand out substantially horizontally from the concave upwind surface of the sail (1) between the two edges (4, 5) of the sail. A similar shielding device is provided at a corresponding location on the opposite surface of the sail, and structure provided for collapsing the respective shielding device on the downwind surface of the sail and erecting the respective shielding device on the upwind surface of the sail.

4 Claims, 2 Drawing Sheets

SAILBOAT SAIL WITH A FULL-WIDTH, FULL-DEPTH, HORIZONTALLY OUTSTANDING SHIELD LOCATED AT AN INTERMEDIATE LEVEL

BACKGROUND OF THE INVENTION

This invention relates to a sail for sailing-boats.

It has been found that the uppermost portion of the sail, the top of the sail, of the normal sails used today on sailing-boats does not contribute to creating the negative pressure required for creating the motive force. If it should be possible, in some way, to have the uppermost portion of the sail contribute to a greater negative pressure formed, the motive force should increase and consequently also the speed of the boat.

SUMMARY OF THE INVENTION

It is an object of the present invention to provide a sail in which the uppermost portion of the sail can also be utilized for increasing the motive force.

This object has been achieved in that the invention has been given the characteristic features defined in the claims.

BRIEF DESCRIPTION OF THE DRAWINGS

The invention is now described in greater detail in the form of a non-restrictive illustrative example shown on the enclosed drawings, wherein.

DETAILED DESCRIPTION

Figure 1:
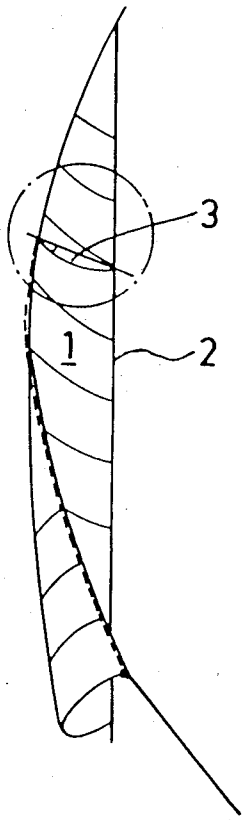
FIG. 1 is a schematic perspective view of a sail according to the invention.

FIG. 1 shows a usual sail 1 hoisted along a mast 2 and stretched by the wind and in this way forming a belly. In accordance with principles of the present invention, the usual sail 1 is shown modified by having a cloth 3 sewn onto the upper part of the sail 1 substantially horizontally upon it, i.e. so that the cloth 3 will extend substantially horizontally when the sail is hoisted and stretched by the wind. The cloth 3 can be made of the same material as the rest of the sail, but is preferably of a thinner material, e.g. nylon.

Figure 2:
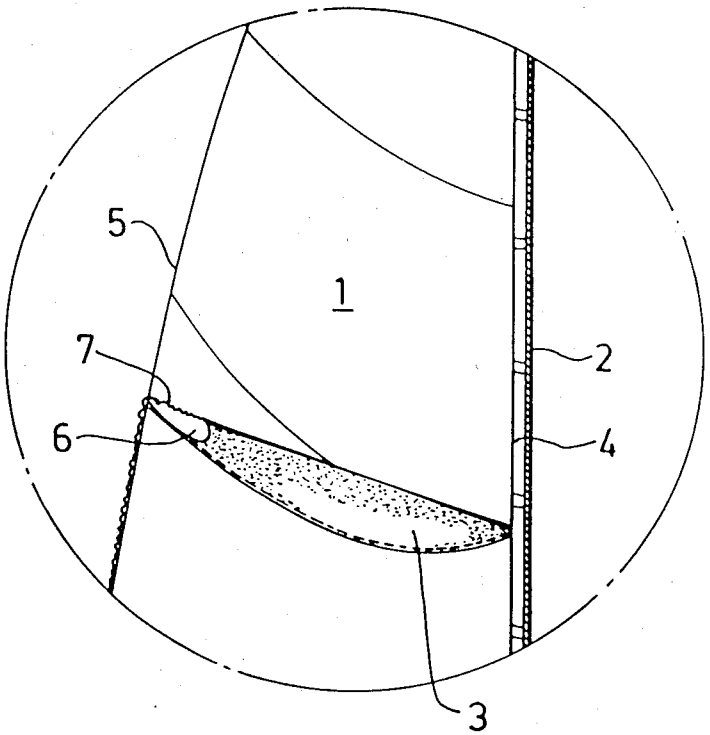
FIG. 2 shows the encircled part of the sail according to the invention on a larger scale.

As appears more clearly from FIG. 2, the cloth 3 is long and narrow and sewn along one side edge thereof so as to extend horizontally across the sail 1. At its end facing the mast 2, the cloth 3 is sewn to the sail as far as up to the sail edge 4 against the mast, while the cloth at the end facing away from the mast 2 preferably does not reach exactly up to the free edge 5 of the sail. Thus, as is apparent from FIG. 2 (and also from FIG. 3), an opening 6 is formed at the free edge 5 of the sail in the area bridged by the cloth 3. At the side edge of the cloth not sewn on, a strapping cord 7 is fastened, by means of which the tension in the side edge of the cloth 3 not sewn on can be adjusted. As is also apparent from FIG. 2 the cloth 3 has such a form that its outer free side edge, when the sail is stretched by the wind, can extend in a substantially straight line from the mast edge 4 of the sail towards the free edge 5 thereof.

Figure 3:
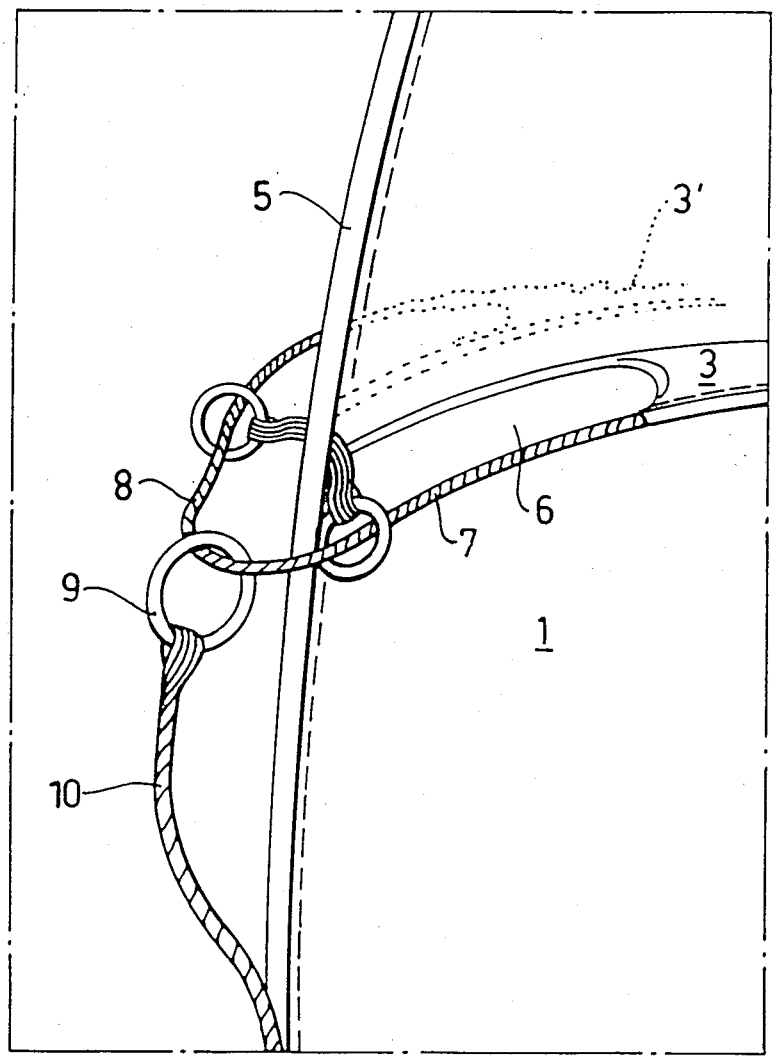
FIG. 3 shows on a still larger scale a detail of the sail according to the invention.

In FIG. 3 it is shown more clearly how the cloth 3 is fastened to the sail 1. It is indicated in this figure that another cloth 3' is also fastened on the other side of the sail straight in front of the cloth 3. The cloth 3' exactly corresponds to the cloth 3, but is reversed in the plane of the sail relative to this. Moreover, it is apparent that the strapping cord 7 from the cloth 3 extends further in a loop 8 around the free edge 5 of the sail and is then fastened to the further cloth 3' on the other side of the sail. A pulling cord 10 is fastened at this loop 8 by means of an eye 9. The pulling cord 10 runs further down along the free edge of the sail to enable an adjustment of the tension of the cloths from the cockpit of the boat or its vicinity.

On the side of the sail that is stretched to be convex the cloth, the cloth 3' in FIG. 3, is lying substantially folded against the sail while the cloth on the concave stretched side of the sail, the cloth 3 in FIG. 3, is stretched so that it stands out horizontally from the surface of the sail, like a shelf. The extent to which this cloth is to be stretched is adjusted by means of the pulling cord 10 which draws out the strapping cord 7 in the loop 8 so that this can adjust the tension in the cloth. As the loop 8 of the strapping cord 7 can run freely through the eye 9 which is fastened to the pulling cord 10, the tension in the pulling cord or strapping cord need not be changed at a tack, but the tension in the cloth on the stretched side will be about the same after a tack as it was in the cloth on the other side of the sail before the tack. Thus, the utilization of the cloth of one side can be changed quite automatically at a tack into utilization of the cloth on the other side of the sail.

By the arrangement of a cloth or another shielding device in this way to bridge the belly (i.e., the concave surface) formed when the wind fills up the sail the sail is in principle divided into two sails, the upper part that would otherwise not contribute to the motive force now increasing this. It has been found that an increase of the motive force of up to about 3 to 7% can be obtained by means of a cloth 3 arranged at the top of the sail 1, in accordance with principles of the present invention.

A sail of the kind described above can be used for most sails used today on sailing-boats. It is further possible to arrange several cloths or other shielding devices above each other on the same side of the sail so that the sail can be divided into more sections than two.

Moreover, as is apparent from the claims it is not necessary that the shielding device consist of a cloth, but it can possibly also be a more fixed construction arranged to bridge the concavity formed when the wind fills up the sail.

What is claimed is:

1. A sailboat sail, comprising:

a sheet of material of generally triangular outline having a generally horizontal lower edge and, extending upwards from said lower edge to an apex, a mast edge and a free edge, said material having two opposite surfaces and being sufficiently flexible that, rigged and in use in a wind, the sheet is concave between said mast edge and said first edge on whichever said surface is upwind when a said surface is upwind and an opposite said surface is downwind, and convex between said mast edge and said free edge on whichever said surface is downwind when a said surface is downwind and an opposite said surface is upwind;

at least one horizontally elongated flexible, lamella-like shielding device having two opposite side edges and two opposite ends;

said shielding device being disposed on one said surface of said sail at a level intermediate said lower edge and said apex, with one said side edge thereof secured therealong to said sheet and the other said side edge thereof standing free of said sheet when said sheet is maximally billowed by the wind when said surface is disposed upwind, in a substantially straight line extending substantially from said mast edge of said sheet substantially to said free edge of said sheet, whereby a concavity defined by said one surface of said sheet is substantially fully divided depthwise thereof into an upper portion located above said shielding device and a lower portion located below said shielding device, wherein when said surface is not disposed upwind said shielding device remains collapsed against said surface.

2. The sailboat sail of claim 1, wherein:

said shielding device is constituted by a piece of cloth sewn along one side edge to said sheet.

3. The sailboat sail of claim 2, further including:

a second substantially identical piece of cloth sewn along a corresponding one side edge thereof to said sheet at said level on the other said surface of said sheet and disposed to remain stowed flat against said other surface until said other surface becomes upwind and then to stand-out horizontally from said other surface, as the first-described said piece of cloth collapses against said one surface of said sheet as said one surface becomes no longer upwind.

4. The sailboat sail of claim 3, further including:

a strapping cord attached to the other side edge of each said piece of cloth and extending in loop around said mast edge of said sheet; and a pulling cord connected to said strapping cord in said loop and extending downwardly from said loop for permitting a sailor to controllingly loosen and tighten said strapping cord.

* * * * *